United States Patent [19]

Ito et al.

[11] Patent Number: 4,811,053

[45] Date of Patent: Mar. 7, 1989

[54] COPY COUNTER AND IMAGE FORMING APPARATUS HAVING COPY COUNTER

[75] Inventors: Masazumi Ito; Kimihiko Higashio, both of Osaka, Japan

[73] Assignee: Minolta Camera Kabushiki Kaisha, Osaka, Japan

[21] Appl. No.: 122,925

[22] Filed: Nov. 19, 1987

[30] Foreign Application Priority Data

Jul. 3, 1987 [JP] Japan ..... 62-167570

[51] Int. Cl.[4] ..... G03G 15/00

[52] U.S. Cl. ..... 355/14 CU; 355/14 SH

[58] Field of Search ..... 355/14 CU, 14 R, 14 SH, 355/3 SH; 377/13, 15

[56] References Cited

U.S. PATENT DOCUMENTS

| | | | |
|---|---|---|---|
| 4,222,660 | 9/1980 | Furuichi et al. | 355/14 R |
| 4,383,756 | 5/1983 | Hanamoto et al. | 355/14 CU |
| 4,391,508 | 7/1983 | Shibusawa | 355/14 CU |
| 4,417,350 | 11/1983 | Ito et al. | 355/14 CU |
| 4,611,904 | 9/1986 | Wada | 355/14 SH |
| 4,711,556 | 12/1987 | Abuyama | 355/14 CU |

*Primary Examiner*—R. L. Moses

*Attorney, Agent, or Firm*—Burns, Doane, Swecker & Mathis

[57] ABSTRACT

An image forming apparatus having a presettable counter and a display device for displaying the contents of the counter, in such arrangement that when copying operation is carried out in the automatic paper feed mode, the content of the counter is decreased by "1" at a time, and when copying is made in the manual paper feed mode, the content of the counter is increased by "1" at a time. For operation in the automatic feed mode, as is the case with the prior-art arrangement, a required number of copies to be made is preset into the counter and the remaining necessary number of copies to be made is displayed on the display device. When operation is performed in the manual feed mode, the number of copies already made is preset in the counter, and when the contents of the counter reaches the required total number of copies, paper feeding will be stopped.

26 Claims, 4 Drawing Sheets

COPY COUNTER AND IMAGE FORMING APPARATUS HAVING COPY COUNTER

BACKGROUND OF THE INVENTION

1. Field of the Invention

This invention relates to a copy counter which counts the number of copying operations of a copying machine and, more particularly, to a copy counter which counts the number of copying operations in a manual paper feed mode.

2. Description of the Prior Art

Conventionally, copying machines have been so designed that either an automatic paper feed mode in which copying paper sheets are automatically fed from a paper cassette or a manual paper feed mode in which a copying paper sheet is manually supplied to the copying machine at each copying operation.

In the automatic paper feed mode, when the required number of copies to be made is preset by a ten-key or the like, the number is decreased by "1" at every copying operation and when copying for the preset number of copies to be made is completed, copying operation is to be stopped. On this account, a presettable counter (a copy counter) which counts and displays the number of copying operations performed is usually provided.

For copying operations performed in the manual paper feed mode, the provision of a counter has been proposed which counts and displays the number of copies made in manual paper feed, in order to reduce the labor of visually counting the number of copies made (U.S. Pat. No. 4,417,350).

In this prior art counter, however, counting is limited to count the number of copying operations by addition during operation in the manual paper feed mode; and if an original is changed during manual paper feed mode operation, the counter is only able to display a total number of copies made. Such being the case, it has been impossible to know the number of copies made of a particular original. When there are some copies at hand by usual copying or copying previously done, and when the number of copies to be made is known, with the prior-art counter, it has been necessary to calculate how many copies are actually required while copying operations are perfromed in the manual paper feed mode. This has been involved troublesome calculation and, sometimes, it has been necessary to recount the number of copies made any number of times.

SUMMARY OF THE INVENTION

The image forming apparatus of the present invention includes a counter which is presettable in a particular mode and designed to increase the preset number each time a paper sheet is fed, the contents of the counter being displayed on a display device.

It is a first object of the invention to provide an image forming apparatus wherein the content of the counter is subtracted from a preset value in case of the automatic paper feed mode and is added to a preset value in the case of the manual paper feed mode, the resulting content of the counter being displayed on the display device.

A second object of this invention is to provide an image forming apparatus wherein, when a door for opening and closing a sheet insertion port is in opened state, operation is carried out in the manual paper feed mode.

A third object of this invention is to provide an image forming apparatus wherein the reset value for the counter is "1" in case of the automatic paper feed mode, while the reset value for the counter is "0" in case of the manual paper feed mode.

A fourth object of this invention is to provide an image forming apparatus wherein, when no image-forming operation is performed within a predetermined period of time, the counter value is reset to "1" in case of the automatic paper feed mode and to "0" in case of the manual paper feed mode, whereby the apparatus is better adapted for the convenience of its use.

A fifth object of this invention is to provide an image forming apparatus wherein the content of the counter is subtracted from or added to the preset value according to the two respective operation modes.

The above and further objects and features of the invention will more fully be apparent from the following detailed description with accompanying drawings.

DESCRIPTION OF THE PREFERRED EMBODIMENTS

An embodiment of the invention will now be described with reference to the accompanying drawings.

Figure 1:
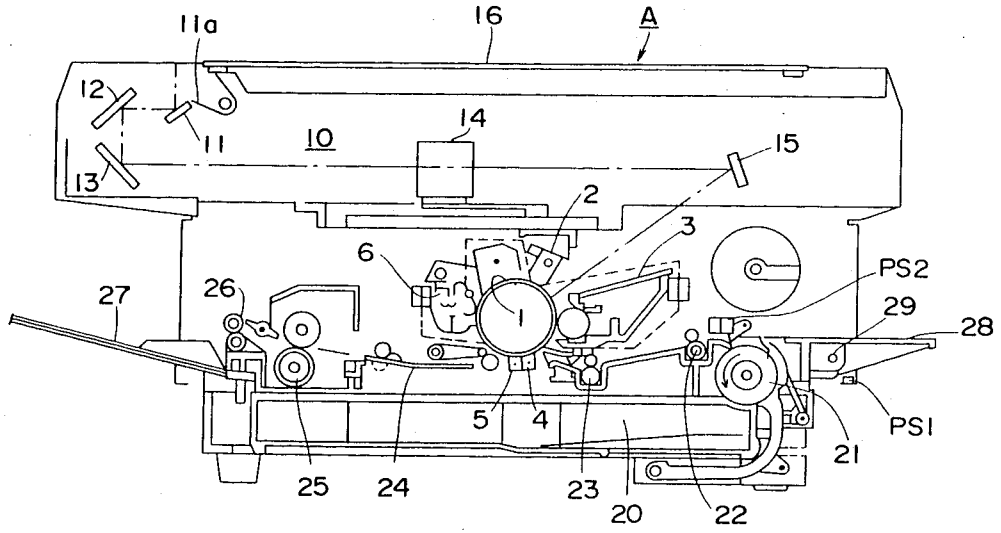
FIG. 1 is a front sectional view of the copying machine of the invention.

FIG. 1 is a front sectional view showing a general arrangement of a copying machine A.

In FIG. 1, a photosensitive drum 1 which is rotatable clockwise is disposed in nearly central part of a copying machine body, there being arranged an electrostatic charger 2, a developing unit 3, a transfer charger 4, a separation charger 5, and a cleaning unit 6 around the drum 1. The photosensitive drum 1 has a photosensitive layer placed on its surface so that it is uniformly charged as it posses through the electrostatic charger, thus being subjected to image exposure by an optical system 10.

The optical system 10, placed under an original glass 16 so as to scan an original image, comprises an exposure lamp 11*a*, movable mirrors 11, 12, 13, a lens 14, and a mirror 15. The exposure lamp 11*a* and the movable mirror 11 are so driven by a scan motor M to move at a velocity of v/n (in which n and v denote copying magnification and the peripheral velocity of the photpsensitive drum 1 respectively) and the movable mirrors 12, 13 to move at a velocity of v/2n.

Copying paper sheets are automatically fed from a paper feeder cassette 20 when in an automatic paper feed mode, while in a manual paper feed mode, copying paper sheets are manually fed from a paper feed tray 28.

That is when in the automatic paper feed mode, copying paper sheets in the paper feed cassette 20 are delivered by a paper feed roller 21 one by one, and after being conveyed through a paper feeder unit by a feed roller 22 and a timing roller 23, each copying sheet passes through a transfer position between the transfer charger 4 and the photosensitive drum 1; at the transfer position a toner image is transferred onto the sheet and then the sheet is delivered to a fixation unit 25 via a copying paper transport unit 24 for fixation. Subsequently, the sheet is discharged onto a discharge tray 27 by a discharge roller 26.

In case of manual paper feeding, the paper feed tray 28 is held open at its position shown with solid line and a copying paper sheet is placed thereon. As the copying paper sheet so placed is forced in, a copying paper sheet detecting sensor PS 2 goes into action and in a given time the paper is fed inward by the feed roller 22. Thereafter, the paper is transported in the same way as in aforesaid case of automatic paper feed.

In the present embodiment, the paper feed tray 28 is adapted to be opened and closed with a shaft 29 being as a supporting point. As the paper feed tray 28 is opened, an open-close sensor PS 1 operates so that paper feed is switched over to the manual paper feed mode. Alternatively, the paper feed tray 28 is made stationary so that when the copying paper sheet detecting sensor ps 2 detects a copying paper pushed in from the paper feed tray 28, the paper feed is switched over to the manual paper feed mode.

Figure 2:
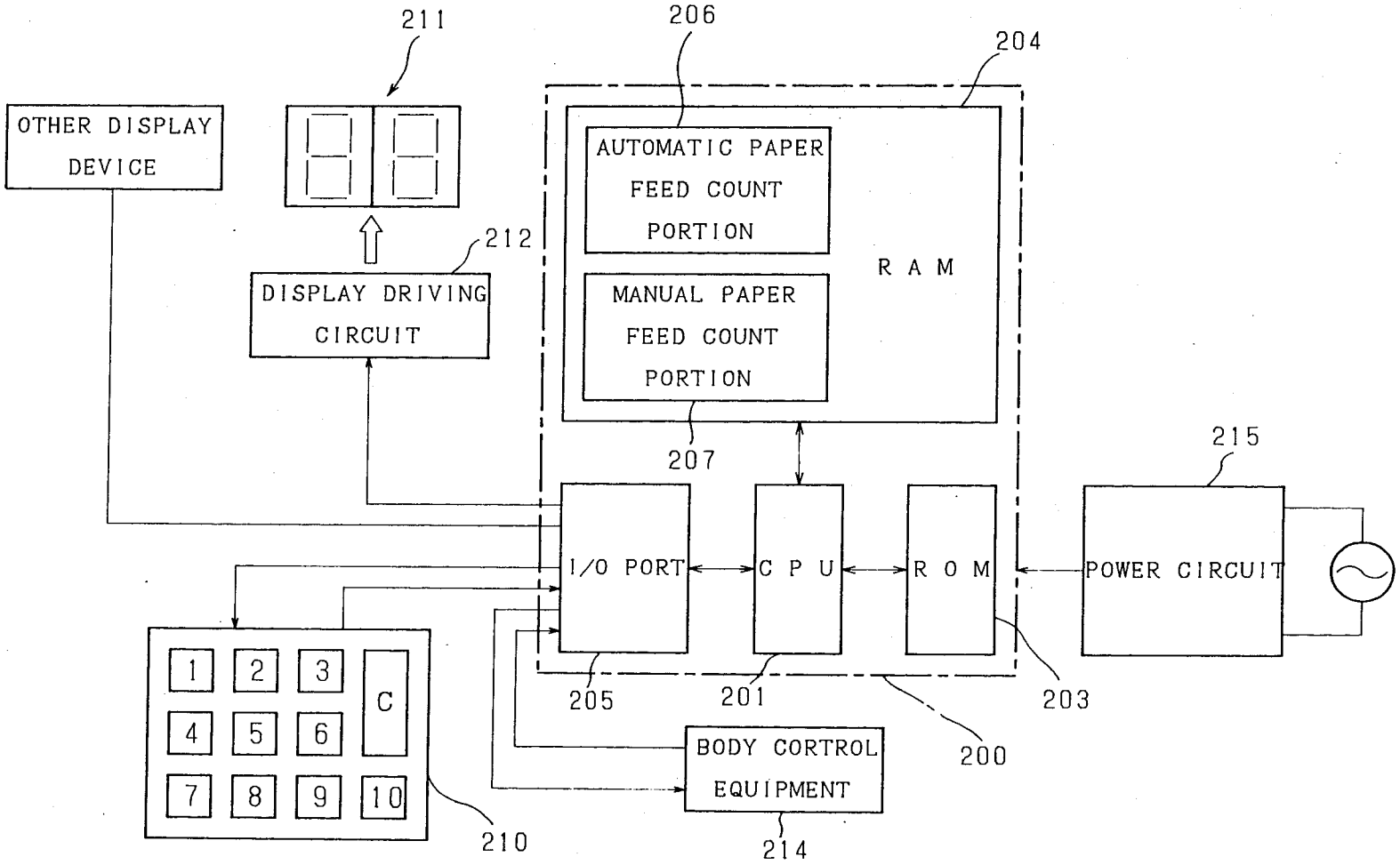
FIG. 2 is a block diagram showing a control circuit of the copying machine.

FIG. 2 is a block diagram showing a control circuit of the copying machine A.

A control unit 200 comprises CPU (central processing unit) 201 consisting of a microprocessor, ROM 203 having a program stored therein, RAM 204, and an input/output port 205. In RAM 204 there are provided areas for an automatic paper feed counting portion 206 for counting times of copying operation (number of copied sheets) in the automatic paper feed mode, and for a manual paper feed counting portion 207 for counting times of copying operation in the manual paper feed mode. In the control unit 200 there are connected, through I/O port 205, a keyboard 210 including register keys of "0" to "9" and a clear key, a numeric value display unit 211, a display drive circuit 212, other display device 213, a body control equipment 214 including motors, clutches, and sensors attached to the copying machine body, and a power circuit 215.

Contents of the automatic paper feed counting portion 206 and manual paper feed counting portion 207, that is, their respective count values are displayed on the numeric value display device 211 through processing at CPU 201. The automatic paper feed counting portion 206 and the manual paper feed counting portion 207 are respectively value-presettable through input of numeric values from the key board 210.

In automatic paper feed mode operation, when a value of more than "2" is preset at the automatic paper feed counting portion 206, the preset value is decreased by "1" at every copying operation, and the current value of counting is displayed on the numeric value display device 211 each time. When the value of counting reaches "0", initiation of a next copying operation is inhibited and thus one cycle of copying operation is completed in terms of a predetermined number of copies. In manual paper feed mode operation, the preset value is increased by "1" at every copying operation and the then count value is displayed on the numeric value display device 211 each time.

Figure 3A:
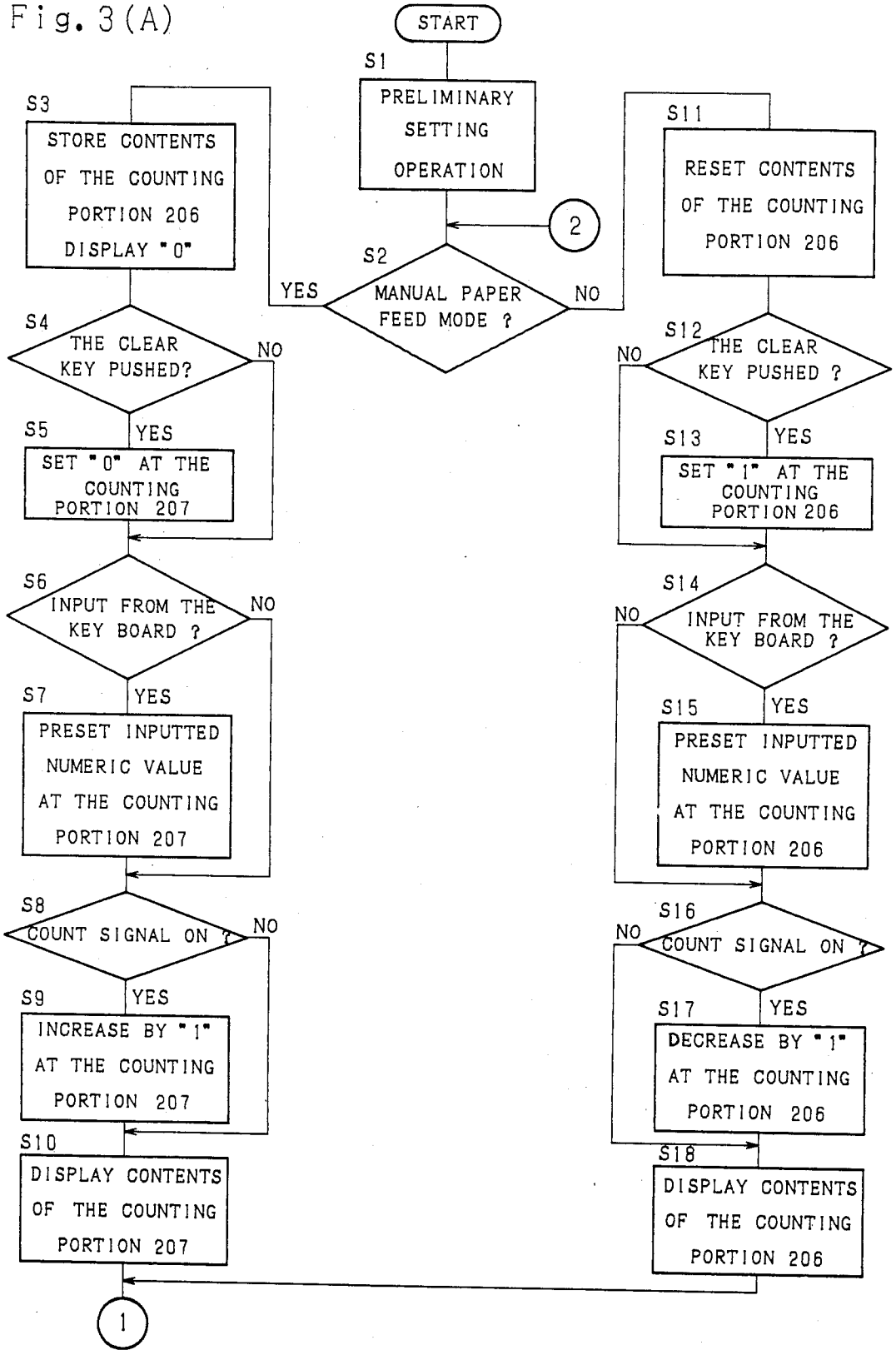
FIG. 3 is a flow chart showing details of control of the coping machine.
Figure 3B:
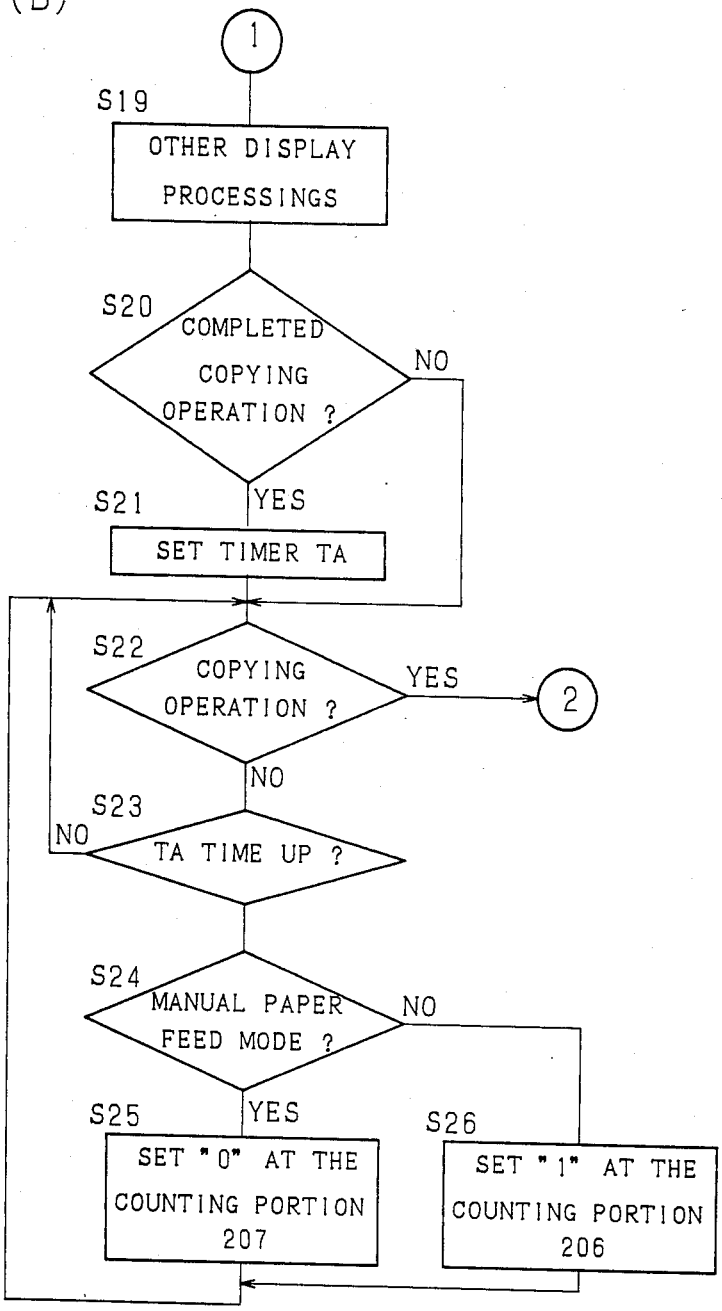

Next, counting operation of the automatic paper feed counting portion 206 and of the manual paper feed counting portion 207 is explained on the basis of the flow chart shown in FIG. 3.

In FIG. 3, at Step #1, when setting operations, including setting of number of copies required, are not carried out by the operator, a preliminary setting operation for standard mode setting, such as automatic display of value "1" on the numerical value display device 211, is performed.

At Step #2, decision is mode on whether or not the operation is of the manual paper feed mode. This is determined by a signal from the tray open-close sensor PS 1 which detects the opening of the paper feed tray 28.

At Step #3, contents of the automatic paper feed counting portion 206 are stored in a relevant area of RAM 204, and the manual paper feed counting portion 207 is correlated with display drive circuit 212. Further, value "0" is displayed on the numeric value display 211. For example, when feed is switched over to manual paper feed mode in the course of continuous copying being made in a plurality of copies in automatic paper feed mode, the rest of the number of copies to be made is stored and simultaneously "0" is displayed on the numeric value display device 211.

At step #4, decision is made on whether or not the clear key "C" has been pushed. If yes, at Step #5 contents of the manual paper feed counting portion 207 are cleared and "0" is displayed.

At Step #6, decision is made on whether or not there has been an input from the keyboard 210. If yes, at Step 7, the numeric value inputted is preset at the manual paper feed counting portion 207.

At Step #8, decision is made on whether or not copying operation has been carried out in the manual paper feed mode and a count signal has been ON. When a count signal has been ON, contents in the manual paper feed counting portion 207 are increased by "1" at Step #9.

At Step #10, contents in the manual paper feed counting portion 207 are displayed on the numeric value display device 211.

At Step #2, when operation is in the automatic paper feed mode and not in the manual paper feed mode, contents in the automatic feed counting portion 206 which have been stored in the relevant area of RAM 204 are reset at Step #11, and the automatic feed counting portion 206 is correlated with the display drive circuit 212.

At Step #12, decision is mode on whether or not the clear key "C" has been pushed. If yes, contents at the automatic counting portion 206 are reset to "1" to display "1" at Step #13.

At Step #14, decision is mode on whether or not there has been an input from the key board 210. If there has been such an input, a value corresponding to the input is preset at the automatic feed counting portion 206 at Step #15.

At Step #16, decision is made on whether or not copyiing operation has been performed in the automatic paper feed mode and a signal has been ON. When a signal is ON, contents in the automatic paper feed counting portion 206 are decreased by "1".

At Step #18, contents in the automatic paper feed counting portion 206 are displayed on the numeric value display device 211.

At Step #19, displays other than the number of copies, such as, for example, copy density, copying paper size, and copying magnification, are processed. Upon completion of copying operation (Yes at Step #20), timer TA is set (Step #21).

When no copying operation is performed in succession thereafter (No at Step #22), CPU 201 waits for time-up of timer TA (Step #23). When operation is in manual paper feed mode (Yes at Step #24), contents at the manual paper feed counting portion 207 are set to "0" (Step #25). When operation is in automatic paper feed mode (No at Step #24), contents at the automatic paper feed counting portion 206 are set to "1" (Step #26). When a copying operation is performed newly, Step #20 and subsequent steps are skipped to return to Step #2. Upon completion of the new series of copying operations, timer TA is set again at Step #21.

In the above described embodiment, a count signal issued at every copying operation is transmitted from CPU 201 at a time when a scanner comprising, for example, exposure lamp 11*a* and mirror 11, completes one scanning operation.

In the foregoing embodiment, the automatic paper counting portion 206 and the manual paper feed counting portion 207 may be consisted of independent hard logics, instead of being placed in areas within RAM 204. In another alternative, one counting portion or one counter may be used for serving the purposes of the two.

According to the invention, as above stated, when copying is performed in the manual paper feed mode, a value "0" is preset prior to copying a particular original, or when some copies are already in hand, the number of such copies is preset, whereby it is easy to know the number of copies required with respect to such particular original.

Therefore, the trouble of copying in the manual paper feed mode while calculating a required number of copies, or recounting the number of copies made again and again, which has often been the case with counters of conventional copying machines, can be effectively eliminated. Thus, according to the invention, it is possible to obtain any required number of copies easily and accurately.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. An image forming apparatus comprising;

means for forming an image on a sheet, first sheet feeder means for storing a plurality of sheets therein and feeding them to the image forming means one at a time.

second sheet feeder means for feeding to the image forming means sheets supplied manually one at a time, means for selecting either a first mode in which copying operation is performed by using the first sheet feeder means or a second mode in which copying operation is performed by using the second sheet feeder means, numeric value input means, numeric value display means, means for outputting a signal corresponding to the operation of the image forming means, means for subtracting "1" at a time from a numeric value inputted from the numeric value input means in response to said signal when the first mode is selected and for displaying the result of said subtraction on the numeric value display means, and means for adding "1" at a time to a numeric value inputted from the numeric value input means in response to said signal when the second mode is selected and for displaying the result of said addition on the numeric value display means.

2. An image forming apparatus as set forth in claim 1, wherein said second sheet feeder means comprise a sheet insertion port, and a freely openable and closable door which causes the sheet insertion port to be exposed when the door is in its opened state and which covers the sheet insertion port when the door is in its closed state.

3. An image forming apparatus as set forth in claim 2, wherein said selection means has means for detecting the opening and closing of the door and are adapted to select the first mode when the closed state of the door is detected and to select the second mode when the opened state of the door is detected.

4. An image forming apparatus as set forth in claim 1, further comprising means for displaying a specified numeric value in response to the selection of the second mode.

5. An image forming apparatus as set forth in claim 4, wherein said specified numeric value is "0".

6. An image forming apparatus as set forth in claim 1, further comprising a means for initiating timing at the end of an operation of said image forming means, and setting means for displaying said specified numeric value on said numeric value display means when no image formation is initiated in succession within a predetermined period of time after the end of the image forming operation.

7. An image forming apparatus as set forth in claim 6, wherein said specified numeric values are different between the ones of the first mode and the second mode.

8. An image forming apparatus as set forth in claim 7, wherein said specified numeric value is "1" when operation is in the first mode and "0" when operation is in the second mode.

9. An image formng apparatus as set forth in claim 1, further comprising a clear key, and setting means for displaying said specified numeric value on said numeric value display means in response to the operation of the clear key.

10. An image forming apparatus as set forth in claim 9, wherein said specific numeric values are different between the ones of the first and second modes.

11. An image forming apparatus as set forth in claim 10, wherein said specific numeric values is "1" when operation is in the first mode and "0" when operation is in the second mode.

12. An image forming apparatus comprising;

means for forming an image on a sheet, first and second sheet feeder means for feeding sheets to said image forming means, means for selecting wither the first sheet feeder means or the second sheet feeder means, numeric value input means, numeric value display means, means for outputting a signal in response to the operation of the image forming means, means for subtracting "1" at a time from a numeric value inputted from the numeric value input means in response to said signal when the first feeder means is selected and for displaying the result of said subtraction on the numeric value display means, and means for adding "1" at a time to a numeric value inputted from the numeric value input means in response to said signal when the second feeder means is selected and for displaying the result of said addition on the numeric value display means.

13. An image forming apparatus as set forth in claim 12, further comprising;

means for initiating timing at the end of an operation of said image forming means, and setting means for displaying a specified numeric value on said numeric value display means when no image formation is initiated in succession within a predetermined period of time after the end of the image forming operation.

14. An image forming apparatus as set forth in claim 13, wherein said specified numeric values differ depending on the sheet feeder means selected.

15. An image forming apparatus as set forth in claim 14, wherein said specified numeric value is "1" when the first sheet feeder means is selected and "0" when the second sheet feeder means is selected.

16. An image forming apparatus as set forth in claim 12, further comprising;

a clear key, and means for displaying a specified numeric value on said numeric value display means in response to the selection of the second sheet feeder means.

17. An image forming apparatus as set forth in claim 16, wherein said specified numeric value is "0".

18. An image forming apparatus comprising:

means forming an image on a sheet, first sheet feeder means and second sheet feeder means for feeding sheets to said image forming means, means for selecting either the first sheet feeder means on the second sheet feeder means, means for displaying numeric values relating to the number of times of image formation, first setting means for displaying a first numeric value on said numeric value display means when no image forming is initiated in succession within a predetermined period of time after the end of an image forming operation using the first sheet feeder means, and second setting means for displaying a second numeric value on said numeric value display means when no image forming is initiated in succession within a predetermined period of time after the end of an image forming operation using the second sheet feeder means.

19. An image forming apparatus as set forth in claim 18, wherein the first sheet feeder means stores a plurality of sheets and automatically delivers the sheets one at a time to the image forming means, while the second sheet feeder means delivers to the image forming means each sheet manually inserted into an insertion port for manual sheet feeding.

20. An image forming apparatus as set forth in claim 18, wherein the first numeric value is "1" and the second numeric value is "0".

21. An image forming apparatus comprising;

means for forming an image on a sheet, first sheet feeder means and second sheet feeder means for feeding sheets to said image forming means, means for selecting either first sheet feeder means or second sheet feeder means, means for displaying a numeric value related to the number of times of image formings, a clear key, first control means for displaying first numeric value on said numeric value display means in response to the operation of the clear key when the first sheet feeder means is selected, second control means for displaying second numeric value on said numeric value display means in response to the operation of the clear key when the second sheet feeder means is selected.

22. An image forming apparatus as set forth in claim 21, wherein said first sheet feeder means stores a plurality of sheets therein and automatically delivers them one at a time to the image forming means, and second sheet feeder means delivers to the image forming apparatus the sheets manually inserted into an insertion port for manual sheet feeding.

23. An image forming apparatus as set forth in claim 21, wherein the first numeric value is "1" and the second numeric value is "0".

24. A counter for sheet counting mounted in an image forming apparatus comprising;

means for inputting an arbitrary number manually, numeric value display means, means for inputting a signal at every image forming operation, means for selecting either first mode or second mode, means for subtracting "1" at a time from a numeric value inputted form said numeric value input means in response to said signal when operation is in the first mode and for displaying the result of the subtraction on the numeric value display means, and means for adding "1" at a time to a numeric value inputted from said numeric value input means in response to said signal when operation is in the second mode and for displaying the result of the addition on said numeric value display means.

25. A counter as set forth in claim 24, further comprising a clear key, means for displaying first numeric value on said numeric value display means in response to the operation of the clear key when the first mode is selected and means for displaying second numeric value on said numeric value display means in response to the operation of the clear key when the second mode is selected.

26. A counter as set forth in claim 25, wherein the first numeric value is "1", and the second numeric value is "0".

* * * * *